United States Patent [19]

Brill

[11] Patent Number: 4,484,746

[45] Date of Patent: Nov. 27, 1984

[54] GOLF PUTTER

[76] Inventor: Edward F. Brill, 5150 Lakeshore Dr., Oconomowoc, Wis. 53066

[21] Appl. No.: 370,379

[22] Filed: Apr. 21, 1982

Related U.S. Application Data

[63] Continuation-in-part of Ser. No. 113,651, Jan. 20, 1980, abandoned.

[51] Int. Cl.[3] ..... A63B 53/00

[52] U.S. Cl. ..... 273/167 A; 273/162 E; 273/164

[58] Field of Search ..... 273/77 R, 78, 79, 163 R, 273/163 A, 164, 167–175, 183 D, 193 R, 194 R, 80 C

[56] References Cited

U.S. PATENT DOCUMENTS

| | | | |
|---|---|---|---|
| D. 179,246 | 11/1956 | Gillon | 273/164 X |
| 2,842,369 | 7/1958 | East | 273/164 |
| 2,995,375 | 8/1961 | Bukovey | 273/167 G X |
| 3,806,129 | 4/1974 | Burrows | 273/167 A X |
| 3,841,641 | 10/1974 | Bennett | 273/80 C X |
| 3,967,826 | 7/1976 | Judice | 273/80 C X |
| 4,000,902 | 1/1977 | Perkins | 273/167 A X |
| 4,240,636 | 12/1980 | Swenson | 273/164 X |

FOREIGN PATENT DOCUMENTS

| | | | |
|---|---|---|---|
| 186522 | 10/1922 | United Kingdom | 273/164 |

OTHER PUBLICATIONS

"Golf Digest: Score Shaver"; Apr. 1980; p. 146.

*Primary Examiner*—Richard J. Apley
*Assistant Examiner*—Chris Coppens
*Attorney, Agent, or Firm*—Michael, Best & Friedrich

[57] ABSTRACT

The juncture between the sole and at least one side of the golf putter head forms a sharp corner which extends generally parallel to the longitudinal axis of the head and serves as an edge for biting into the green surface and resisting endwise turning of the club head relative to the desired putting line as the golfer starts tilting the club head from an aiming position toward an address position. The sole has at least two convex contact points for maintaining rolling contact with the green and resisting turning of the club head as the biting edge is elevated from the green. The opposite ends of the head are provided with striking faces and the sole has upwardly curved outer end portions for riding over the ground when the ends are used to strike a golf ball. The slope of the green can be determined with a ball trough in the club head and indicia on the club head can be used to check alignment of the putter face when the head is in both the aiming and address positions.

15 Claims, 25 Drawing Figures

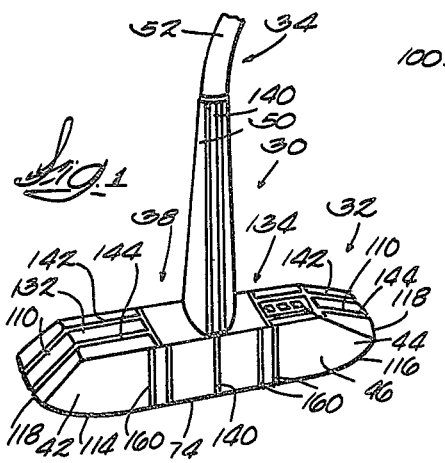
Fig. 1
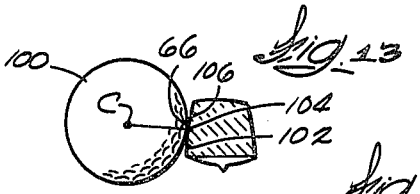
Fig. 13
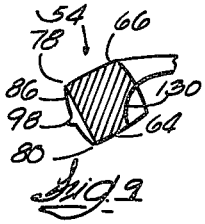
Fig. 9
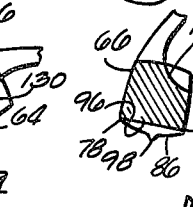
Fig. 10
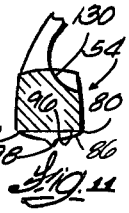
Fig. 11
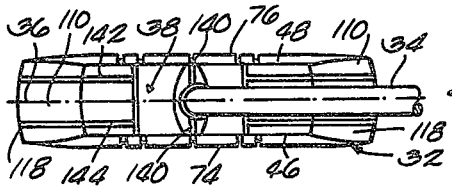
Fig. 2
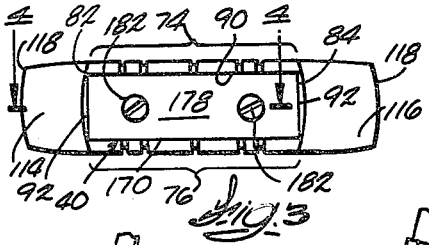
Fig. 3
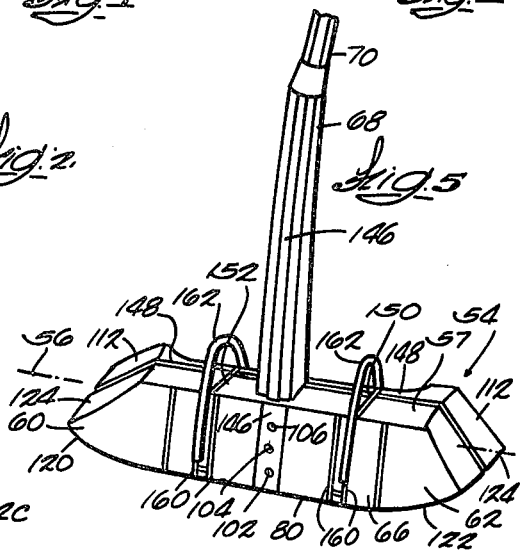
Fig. 5
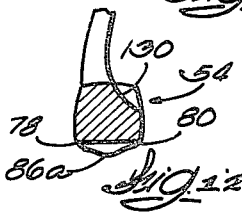
Fig. 12
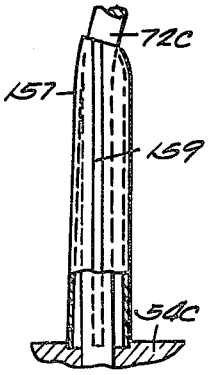
Fig. 21
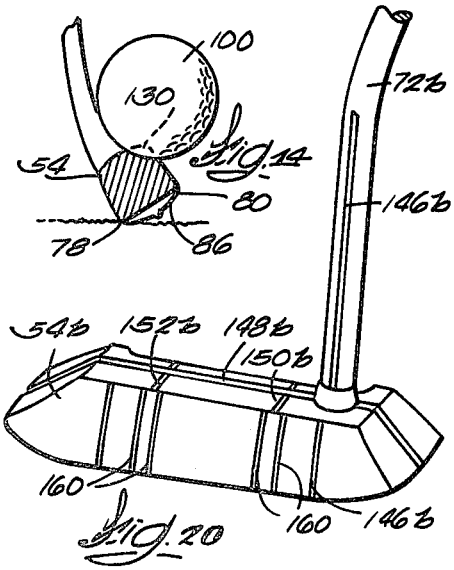
Fig. 14
Fig. 20
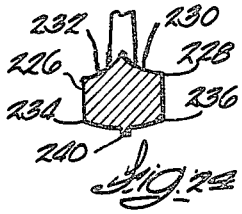
Fig. 22
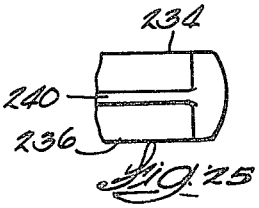
Fig. 25

GOLF PUTTER

CROSS REFERENCE TO RELATED APPLICATION

This is a continuation-in-part of application Ser. No. 113,651 filed Jan. 20, 1980 now abandoned.

BACKGROUND OF THE INVENTION

This invention relates to golf putters and, more particularly, to golf putters including means for assisting the golfer in obtaining and maintaining the proper club head orientation for striking a golf ball along an intended putting line. This invention also relates to putters arranged to be usable as an extra club and including other improved features.

Because accurate putting can save a significant number of strokes, there is a continuing demand for golf putters which are arranged to minimize improper striking of a golf ball because of club head misalignment before and after addressing the ball, inaccurate roll or spin on the ball, misreading green breaks, etc.

A number of prior patents relate to golf clubs, particularly putters, including an arcuate putting or driving face arranged to alleviate a variety of stroking problems. Representative examples of such prior patents include U.S. Pat. Nos. 1,409,966 (Plant), 1,467,714 (Doerr), 3,368,812 (Baldwin), 3,989,257 (Barr) and 4,162,074 (Thomson) and Austrailian Pat. No. 105,759 (Brooks).

Representative prior patents relating to putter sole designs include U.S. Pat. Nos. 3,042,405 (Solheim), 3,191,936 (Guier) and 3,967,826 (Judice), U.S. Pat. No. Des. 218,108 (Wegener) and British Pat. No. 739,403 (Spalding).

Representative prior patents relating to golf putters including means for aiming, aligning the club head identifying the "sweet spot" and practicing hitting the "sweet spot" include U.S. Pat. Nos. 2,820,638 (Morrison), 2,991,082 (Handzlik), 3,039,776 (Faini), 3,549,300 (Pelz), 3,880,430 (McCabe), and 4,000,902 (Perkins) and 4,240,636 (Swenson) and U.S. Pat. Nos. Des. 179,246 (Gillon) and 235,893 (Becker).

Representative prior patents relating to golf clubs having striking faces on the ends includes U.S. Pat. No. 1,537,711 (Spafford) and British Pat. No. 8336 (Samuel).

Representative prior patents relating to golf putters including a provision for adjusting the weight includes U.S. Pat Nos. 2,954,231 (MacIntyre) and 3,143,349 (MacIntyre).

None of these patents disclose a golf putter including the combination of the novel features incorporated into the golf putter of the present invention.

SUMMARY OF THE INVENTION

A principal object of the invention is to provide a golf putter including simple, effective means for preventing the club head from being accidentially twisted by the golfer as he moves it from a tilted aiming position to an upright address position.

Another principal object of the invention is to provide a golf putter including indicia permitting the golfer to identify the "sweet spot" when in the address position and to quickly verify whether the club head is properly aligned relative to the ball.

Another principal object of the invention is to provide a golf putter including striking faces on the toe and heel of the club head arranged to faciliate convenient hitting the ball when in normally unplayable lies.

Another principal object of the invention is to provide a golf putter including a putting face capable of producing a range of loft angles and having indicia on the putting face corresponding to a predetermined loft angle.

Another principal object of the invention is to provide a golf putter including means for determining the slope of the green.

Another principal object of the invention is to provide a golf putter including practice means for limiting the contact area of the "sweet spot".

Other objects, aspects and advantages of the invention will become apparent to those skilled in the art upon reviewing the following detailed description, the drawings and the appended claims.

The invention provides a golf putter comprising a club head having an elongated body including a sole and opposed sides extending generally parallel to the longitudinal axis of the body with at lease one side being a putting face. A substantial portion of the juncture between the sole and at least one of the sides forms a sharp corner which extends longitudinally in a substantially straight line generally parallel to the longitudinal axis of the body and serves as an edge for biting into a green surface when the golfer tilts the club head towards the green surface from an upright position to an aiming position and applies a small downward force on the shaft. The biting edge resists endwise turning of the club head relative to the desired putting line as the golfer starts to tilt the club back to an address position. The sole has longitudinally spaced convex surface portions extending downwardly beyond the biting edge for maintaining rolling contact with the green surface and thereby resisting endwise turning of the club head relative to the desired putting line as the golfer tilts the club head from an aiming position to an address position after the biting edge has been elevated from the green surface.

In the one embodiment, the putting face includes a striking area having a generally convex vertical curvature for providing a predetermined range of loft angles and a plurality of vertically spaced indicia on the striking area corresponding to a predetermined loft angle when contacted with a golf ball in a direction toward the center of gravity of the golf ball.

In one embodiment, the opposed ends of the club head define a toe and heel having a lofted striking face extending in a plane which is generally perpendicular to the longitudinal axis of the club head and vertically inclined toward the shaft. The striking faces terminate at a lower edge above the bottom most part of the sole and the sole includes opposed outer ends portions which curve smoothly longitudinally upwardly from the bottommost part of the sole and joins the lower edges of the toe and heel striking faces to serve as surfaces for riding over the ground when the toe or heel is used to strike a golf ball.

In one embodiment the club head has at least one pair of longitudinally spaced vertical grooves in the putting face and the other side. The grooves are located on the opposite sides of and equally spaced from the center of the "sweet spot" and removably receive the legs of U-shaped spring members. The grooves are spaced apart a sufficient distance to provide a golf ball contact area on the putting face between the spring members when installed.

In one embodiment, an elongated ball trough is provided on one side of the top of the club head. The ball trough extends longitudinally generally parallel to the longitudinal axis of the club head and has concave cross section approximating the curvature of a golf ball such that, when the club head is tilted with the straight or biting edge opposite to the ball trough resting on a slope portion of a green, a golf ball placed in the ball trough will roll along the trough in the direction of the slope.

In one embodiment, a hosel is formed integrally with and extends vertically upwardly from the club head top and vertical aiming indicia extending perpendicularly to the longitudinal axis of the club head is provided on the hosel. This vertical aiming indicia can extend on the putting face and through the center of the "sweet spot" of the putting face. To further enhance proper orientation of the club head in the address position, longitudinal alignment indicia extending perpendicularly to the vertical aiming indicia can be provided on the top of the club head.

BRIEF DESCRIPTION OF THE DRAWINGS

FIG. 1 is a fragmentary, perspective view of a golf putter embodying the invention in which the club head has putting faces on both sides and a central hosel in which the shaft is connected.

FIG. 2 is a top plan view of the golf putter shown in FIG. 1.

FIG. 3 is a bottom plan view of the golf putter shown in FIG. 1.

FIG. 5 is a fragmentary perspective view of another embodiment of the golf putter having a single putting surface and the shaft in front of the club head, shown with detachable practice arches installed.

FIGS. 9–11 are cross sectional views of the club head of the golf putter shown in FIG. 5, illustrating the biting and roll over action of the sole during tilting of the putter head from an aiming position to an address position.

FIG. 12 is a fragmentary cross sectional view of an alternate arrangement for the roll over surfaces of the club head.

FIG. 13 is a fragmentary, end elevation view of the putter shown in FIG. 5, illustrating the relationship between the arcuate putting face and the golf ball for obtaining different degrees of loft.

FIG. 14 is a fragmentary cross sectional view of the golf putter shown in FIG. 5, illustrating the club head tilted to a position for determining the slope of a green.

FIG. 20 is a perspective view of another embodiment of the golf putter having the shaft connected directly to the head near the heel.

FIG. 21 is an enlarged fragmentary view of another embodiment of the golf putter having the shaft mounted in the head and a slip-on ferrule for increasing the length of the vertical aiming indicia.

FIG. 24 is a fragmentary cross sectional view of an alternate arrangement for the club head including a pair of ball troughs on the top and a central rib on the sole as a gripping means.

FIG. 25 is a fragmentary, bottom plan view of the club head shown in FIG. 24.

DESCRIPTION OF THE PREFERRED EMBODIMENTS

Figure 6:
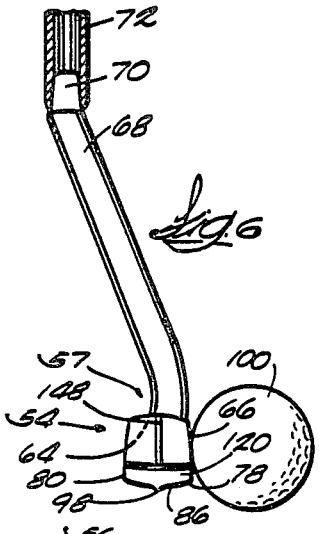
FIG. 6 is an end elevation view of the golf putter shown in FIG. 5, shown in an address position ready to strike a golf ball.

Referring to FIGS. 1–4, a golf putter 30 embodying the invention includes a club head 32 and a shaft 34 (illustrated fragmentarily) connected to the club head 32 and having a conventional grip (not shown). The club head 32 has an elongated body including a longitudinal axis 36 which extends generally perpendicular to the putting direction when the club head 32 is in the upright address position illustrated in FIG. 2.

The club head 32 has a top surface 38, a bottom or sole 40, opposed ends 42 and 44, and opposed sides 46 and 48 which extend generally parallel to the longitudinal axis 36 of the club head 32. At least on one of the sides 46 and 48 is a putting face. In the embodiment illustrated in FIGS. 1–4, both sides 46 and 48 are putting faces and are mirror images of each other. The club head 32 includes a centrally located hosel 50 formed integrally with and extending vertically upwardly from the club head body. The lower end 52 of the shaft 34, which is inclined to the vertical at an angle of about 16½ degrees, is inserted into and suitably affixed to the hosel 50. Thus, the club putter 30 illustrated in FIGS. 1–4 can be used by either right or left hand golfers.

Figure 7:
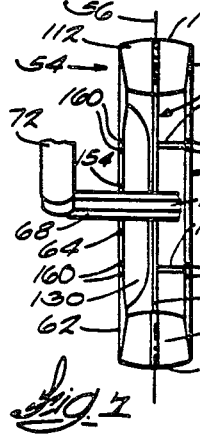
FIG. 7 is a top plan view of the golf putter shown in FIG. 5.
Figure 8:
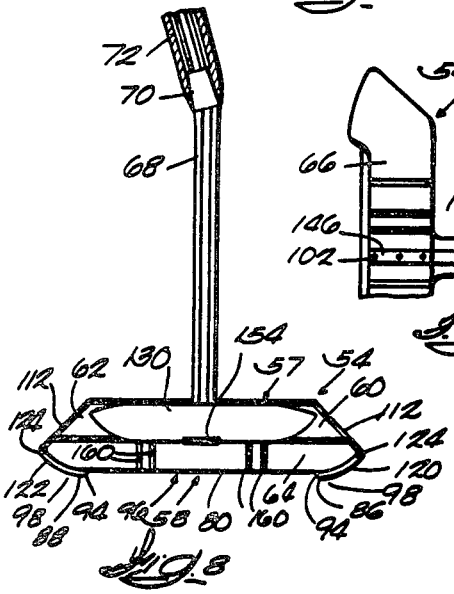
FIG. 8 is a rear elevation view of the golf putter shown in FIG. 5.

FIGS. 5–8 illustrate an alternate arrangement for a club head having only one putting face and hosel which is arranged so that the shaft is back of the club head. Like the embodiment illustrated in FIGS. 1–4, the club head 54 has an elongated body and the longitudinal axis 56 thereof extends generally perpendicular to the putting direction when in an upright address position. Similarly, the club head body has a top surface 57, a bottom or sole 58, opposed ends 60 and 62, a back side 64 and a front side 66 which is the putting face. A hosel 68, located at the midpoint between the ends 60 and 62, is formed as an integral part of the club head and extends perpendicularly to the longitudinal axis 56 as best shown in FIG. 8, but at a forward incline relative to a vertical plan intersection the longitudinal axis 36 as best shown in FIGS. 6 and 7. The upper end 70 of the hosel 68, which is inclined to the vertical at an angle of about 16½ degrees, is inserted into and suitably affixed to the lower end of a straight shaft 72 (illustrated fragmentarily).

In both embodiments, the club head sole is arranged in a manner to minimize endwise twisting (with resulting club head misalignment) after the golfer tilts the club head toward the green for aiming and returns it to an upright address position. This is accomplished, in part, by forming a substantial portion of the juncture between the sole and one or both sides as a sharp corner or edge which extends in a substantially straight line generally parallel to the longitudinal axis of the club body. These edges serve as biting edges when the club is tilted to an aiming position as explained in more detail below.

In one embodiment illustrated in FIGS. 1–4, the biting edges are designated by reference numerals 74 and 76 with the approximate length indicated by the brackets in FIG. 3. In the embodiment illustrated in FIGS. 5–8, the biting edges are designated by the reference numerals 78 and 80 in FIG. 6. The portions of the sole and a side forming a biting edge can be at an obtuse angle or an acute angle so long as a sharply defined corner is provided.

The club head sole includes longitudinally spaced convex surface portions which extend downwardly from the biting edges and serve as roll over surfaces when the club is returned from an aiming position to an address position as explained below.

In the embodiment illustrated in FIGS. 1–4, the roll over surfaces are designated by reference numerals 82 and 84 in FIG. 3. In the embodiment illustrated FIGS. 5–8, the roll over surfaces are designated by reference 86 and 88 in FIG. 8.

Operation of a biting edge and the roll over surfaces are illustrated in FIGS. 9–11 with reference to the embodiment illustrated in FIGS. 5–8. For sake or clarity, only one roll over surface 86 is illustrated in FIGS. 9–11.

Once a golfer has tilted the club head 54 to an aiming position and oriented it relative the ball to provide the desired putting line (FIG. 9), the application of a small downward force on the shaft 72 causes the biting edge 80 to bite into the green and thereby resist endwise twisting of the club head 54 as it is tilted back to an address position. As the golfer tilts the club head 54 back to an address position FIGS. 9 and 10, while continuing to apply small downward force on the shaft, the roll over surfaces 86 and 88 are maintained in rolling contact with the green to resist endwise twisting of the club head 54 after the biting edge 80 has been elevated from the green surface. The two point contact provided by the longitudinally spaced roll over surfaces 86 and 88 further minimizes such endwise twisting.

It should be appreciated that the club head can be tilted over onto biting edge 78 for aiming and the roll over action would be the same as described above.

FIG. 12 illustrates an alternate arrangement for the roll over surfaces. In this embodiment, the convex portion of the roll over surfaces **86*a* (and the other roll over surface not shown) does not extend all the way to the biting edges 78 and 80**.

Gripping means can be provided on the club head sole to minimize transverse slippage of the club head relative to the desired putting line as the club head is tilted back to the address position. In the embodiment illustrated in FIGS. 1–4, the sole 40 includes a central recess 90 for weights as described in more detail below. The transverse edges or inner ends of the roll over surfaces 82 and 84 terminate adjacent the ends of the recess 90 in an offset portion forming a sharp corner 92 extending in the direction of roll over generally perpendicular to the longitudinal axis 36 of the club head body. These corners 92 tend to bite into the green surface and thereby resist transverse slippage of the club head.

In the embodiment illustrated in FIGS. 5–8, similar corners 94 are formed between roll over surfaces 86 and 88 and an elongated, central recessed portion 96 in the sole 58. In the specific embodiment illustrated, further gripping against transverse slippage is provided by a downwardly extending sharp projection 98 located at the midpoint of each of the roll over surfaces 86 and 88. These projections 98 dig into the green so long as the roll over surfaces are maintained in contact with the green surface. Their lengths are kept to a minimum in order to prevent scuffing during putting. When the projections 98 are used, the entire straight portion of the club head sole can be convex if desired. That is, the recessed portion 96 can be omitted so long as at least one of the straight biting edges 78 and 80 are provided as discussed above.

The putting face or faces of the club head includes a striking area having a generally convex vertical curvature, i.e., a circular arc in the striking direction, for providing a predetermined range of loft angles depending on the point of contact with a golf ball relative to its center of gravity. Referring to FIGS. 5 and 13, the putting face 66 had a radius relative to a golf ball 100 which will provide a range of loft angles, preferrably about 1 to about 10 degrees. The striking area is provided with a plurality of vertically spaced indicia 102, 104 and 106 corresponding to predetermined loft angle when contacted with the golf ball 100 in a direction towards the center of gravity "C".

The indicia preferably are spaced at equal degree intervals. For example, indicia 102, 104 and 106 can correspond to loft angles of $2\frac{1}{2}$, 5 and $7\frac{1}{2}$ degrees, respectively. Through practice and observing which indicia strikes the center of the ball, the golfer can determine which elevation of the putter face relative to the golf ball provides the desired ball roll for different distances and breaks in the green.

The ends of the club head preferably are provided with lofted striking surfaces so that the putter can be used as an extra club to make toe and heel shots for normally unplayable lies, such as the golf ball lying next to an obstruction. For toe shots, the putter can be used in a manner similar to an iron club to drive the ball up to about 100 yards. A heel shot can be made by shooting the ball between the legs (either rearwardly or forwardly) much like a croquet mallet.

In the embodiment illustrated in FIGS. 1–4, both the toe end 42 and the heel end 44 have a striking face 110 extending in a plane which is generally perpendicular to the longitudinal axis 36 of the club head body and vertically inclined toward the hosel 50. In the embodiment illustrated in FIGS. 5–8, both the toe end 60 and the heel end 62 have a striking face 112 extending at a plane which is generally perpendicular to the longitudinal axis 56 of the club head body and vertically inclined toward the hosel 68. The incline of the striking surfaces 110 and 112 preferably is about 20 to about 50 degrees, most preferably about 45 degrees. Also, the striking surfaces 110 and 112 preferably are bulged or crowned, i.e., have both a convex transverse curvature and a convex vertical curvature, to improve their effectiveness in producing a lofted shot.

In both of the above embodiments, the striking faces terminate at a lower edge located some distance above the bottommost part of the sole, preferably at a point below mid-elevation of the club head body. The club head sole has opposed outer end portions which curve smoothly upwardly from the bottommost part of the sole, such as the roll over surfaces, to the lower edge of the respective striking face. These surfaces permit the club head to ride over the ground when a toe or heel shot is made. Without these ride surfaces, the downward force component produced when a golf ball is struck with the inclined striking face of a toe or heel tends to cause the head to dig into the ground with a loss in distance and/or stinging vibrations being transmitted up the shaft. The curved ride surface creates a "ski-like" action as it rides along the ground and/or takes up turf, producing an upper reaction to counteract the downward force component.

To best serve the above purpose, the ride surfaces preferably are compoundly curved. That is, in addition to being curved or rounded toward the lower edge of the striking face, they also have a generally convex transverse curvature with respect to the longitudinal axis of the club head body.

In the embodiment illustrated in FIGS. 1–4, ride surfaces 114 and 116 respectively extend from the roll over surfaces 82 and 84 to a lower edge 118 of a striking face 110. In the embodiment illustrated in FIGS. 5–8, ride surfaces 120 and 122 respectively extend from the roll over surfaces 86 and 88 to a lower edge 124 of a striking face 112.

The club head can include a ball trough for use in determining the slope of a green in one or more given locations. Referring to FIGS. 7, 8 and 14, an elongated ball trough 130 is provided in the club head top 57 on the side opposite to the putting face 66. The ball trough 130 extends longitudinally generally parallel to the longitudinal axis 56 of the club head body and also parallel to the straight biting edge on the opposite side of the club head or biting edge 78. The ball trough 130 has a concave cross section approximating the curvature of a golf ball 100. When the club head 24 is tilted so that the straight biting edge 78 is resting on the green surface and a golf ball 110 is placed in the ball trough 130 as illustrated in FIG. 14, the golf ball 100 will roll along the ball trough 130 in the direction of the green slope. The golf trough 130 preferably does not extend the entire length of the club head 54 as illustrated in FIGS. 7 and 8, so that the golf ball will not roll off the end of the club head when the slope is being checked.

In one embodiment illustrated in FIGS. 1–4, similarly configured ball troughs can be provided on the opposite sides of the centrally located hosel 50. The ball troughs are arranged so that the green slope can be checked as described above by tilting the club head onto either of the straight biting edges 74 and 76.

Various indicia preferably are provided on the club head to assist in aiming and maintaining the desired club head orientation as it is being tilted back to and is in the address position. In the embodiment illustrated in FIGS. 1–4, vertical aiming indicia 140, in the form of a painted strip, a groove or the like extending perpendicularly to the longitudinal axis 36 of the club head (and thus perpendicular to the biting edges 74 and 76), is provided on both sides of the club head. Each aiming indicia 140 extends through the center of the "sweet spot" on the respective putting face and upwardly substantially along the entire height of the straight portion of the hosel 50. The aiming indicia 140 can be used by the golfer to assist in orienting the club head relatively to the golf ball to obtain the desired putting line when the club head has been tilted to an aiming position.

Longitudinally extending orientation indicia 142 and 144, in the form of grooves, painted stripes or the like, are provided on the top surface 38 of the club head. The orientation indicia 142 and 144, which are located on the opposite sides of the centrally located hosel 50, extend parallel to each other and parallel to the longitudinal axis 36 of the club head body. If the club head is in a proper upright position, the shaft will appear to be centrally located between the orientation indicia 142 and 144 when sighted by the golfer in an address position ready to strike a golf ball. If the club head is tilted one way or the other, the shaft will appear to intersect one of the orientation indicia 142 and 144.

Detection of such club head tilt can be further enhanced by extending the orientation indicia 142 and 144 down the striking face 110 of the toe 142, and also the striking face 110 of the heel end 44 if desired. If the club head is in a proper upright position, the indicia 142 and 144 will appear as straight lines along their entire length. If the club head is tilted, the portions of the indicia extending down the striking faces of the toe and heel will appear to be an angle to the portions on the top surface of the club head.

In the embodiment illustrated in FIGS. 5–8, aiming indicia 146 extends vertically through the center of the "sweet spot" of the putting face 66 and along substantially the entire height of the straight portion of the hosel 68 on the putting side. A single orientation indicia 148, which serves the same purpose as indicia 142 and 144 in the embodiment illustrated in FIGS. 1–4, extends longitudinally along the center of the club head top 57 parallel to the biting edges 78 and 80. Parallel spaced indicia 150 and 152 extending perpendicularly to indicia 140 and identifying the boundries of the "sweet spot" can be provided on the top surface 57 of the club head. Also, a short indicia stripe 154 (FIGS. 7 and 8) extending equal distances in opposite directions from the center of the hosel 68 and parallel to the longitudinal axis 56 of the club head can be provided along the bottom edge of the ball trough 130 to indicate toe-to-heel tilt of the club head.

Figure 17:
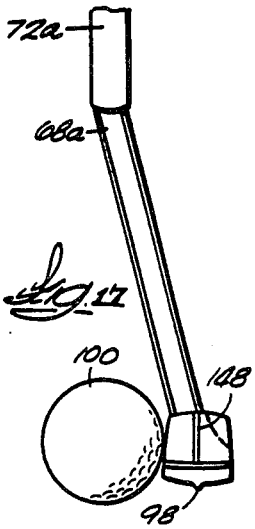
FIG. 17 is an end elevation view similar to FIG. 6 illustrating another embodiment of the golf putter having a single putting face and the shaft in front of the head.
Figure 15:
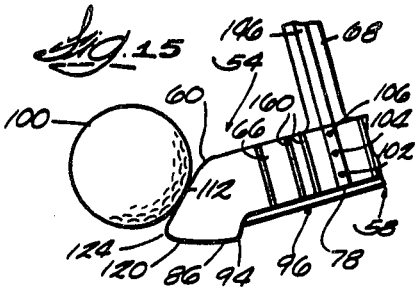
FIG. 15 is a fragmentary view of the golf putter shown in FIG. 5 illustrating a toe shot.
Figure 16:
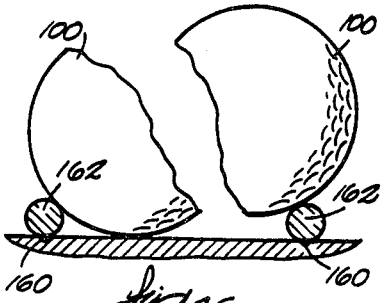
FIG. 16 is an enlarged fragmentary view of the club head of the putter shown in FIG. 5 with the practice arches installed, illustrating proper and improper striking of a golf ball with respect to the "sweet spot".
Figure 18:
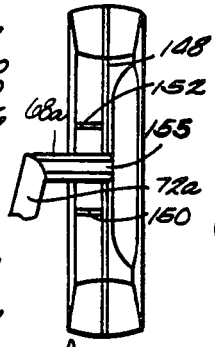
FIG. 18 is a top plan view of the golf putter shown in FIG. 17.
Figure 19:
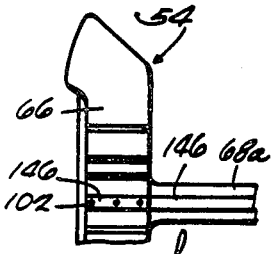
FIG. 19 is an enlarged fragmentary view of the putting face of the golf putter shown in FIG. 17 tiltled to an aimed position.

FIGS. 16–17 illustrate a putter arranged in substantially the same manner as the putter illustrated in FIGS. 5–8, except that the hosel **68*a* is arranged so that the shaft 72*a* is in front of the golf head. In this embodiment, vertical aiming indicia 146 (FIG. 19) is provided on the putting face 66 and the putting side of the hosel 68*a* as described above. In addition, vertical aiming indicia 155 (FIG. 18) extending perpendicularly to the indicia 148 is provided on the back side of the hosel 68*a***.

FIG. 20 illustrates an alternate arrangement in which the shaft **72*b* is mounted directly to the club head 54*b* in an off center location. The vertical aiming indicia 146*b* extends along the straight portion of the shaft 72*b* next to the club head and continues down the putting face at a location off set from the center of the "sweet spot". Otherwise, the club head can be arranged in substantially the same manner as the embodiment illustrated in FIGS. 5–8. A hosel similar to that shown in FIG. 1 and FIG. 5** can be used in this embodiment.

FIG. 21 illustrates an arrangement for increasing the length of the vertical aiming indicia when the shaft **72*c* is mounted directly to the club head. USGA rules limit the distance the bend in the shaft can be from the bottom of the club head which necessarily limits the length of a straight vertical aiming indicia. In this embodiment, a ferrule 157 made from plastic or other suitable material is slipped over the bent shaft 72***c*. The ferrule 157 has a vertically extending aiming indicia 159 and is arranged so that the top end extends above the bend in the shaft 72*c*, thereby permitting the aiming indicia 159 to be somewhat longer for better aiming than would be possible if applied directly to the straight portion of the shaft 72*c*.

Referring to FIGS. 5 and 16, longitudinally spaced, vertical grooves 160 are provided in both the putting face 66 and the back side 64 of the club head 54. Pairs of these grooves 160 are located on the opposite sides of and equally spaced from the center of the "sweet spot". The grooves 160 are adapted to removably receive U-shaped, practice spring members or arches 162 as illustrated in FIG. 5. The grooves 160 are spaced apart a sufficient distance to permit contact of the "sweet spot" with a golf ball when the practice arches 162 are installed as illustrated in the left portion of FIG. 16. This spacing usually is less than the diameter of a golf ball so that, in the event the ball contact one of the arches 162 as illustrated in the right portion of FIG. 16 it is diverted from the intended path.

Two or more pairs of the grooves 162 at different longitudinal spacings can be provided as illustrated to vary the accessible contact area of the "sweet spot" and thereby vary the difficultly of striking the "sweet spot" for improving on the skill of the golfer.

The practice arches 162 preferrably are made from a stiff wire and are arranged to provide a finger space above the top of the club head to facilitate being pulled off the club head. The grooves 160 have a width smaller than the diameter of the wire for the practice arches 162 so as to retain the arches against lateral displacement.

Figure 4:
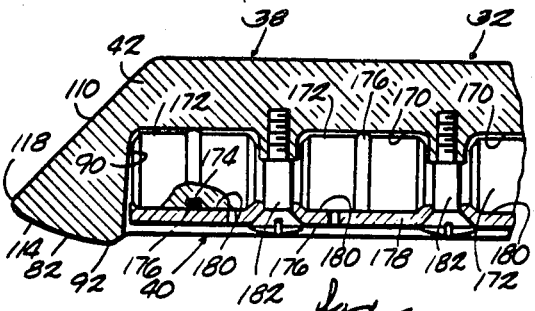
FIG. 4 is an enlarged sectional view taken generally along line 4—4 in FIG. 3.

Referring to FIGS. 3 and 4, the large central recess 90 is generally rectangular and is arranged to receive small cylindrical weights 172 in the order of $\frac{2}{3}$ to $\frac{3}{4}$ ounce each. Each weight 172 has a perpherial groove 174 carrying a resilient member such as a rubber O-ring 176. A small portion of the weights 172 extends outwardly of the recess 90.

The recess 90 is covered by a metal plate 178 including recess portions 180 which are registrable with and receive the extended portions of a weight 172 located in the recess 90. The cover plate 178 is removably mounted over the recess 90 by screws 182 or the like. As the screws 180 are tightened, each O-ring 182 is compressed by the cover plate 178 to provide metal to metal contact between the weights 172 and the cover plate 178 with the weights mechanically registered in the recessed portions 180. The compressed O-ring restrains movement of the weights relative to the cavities and, in combination with the above metal-to-metal contact between the weights and the cover plate, eliminates any rattling. The edges 170 of the cover plate 178 are also in metal to metal contact with the club head so as to prevent a "bell" effect with no weights are installed.

Figure 23:
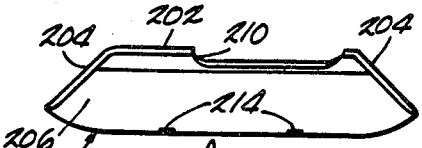
FIG. 23 is a sectional view taken generally along line 23—23 in FIG. 22.
Figure 22:
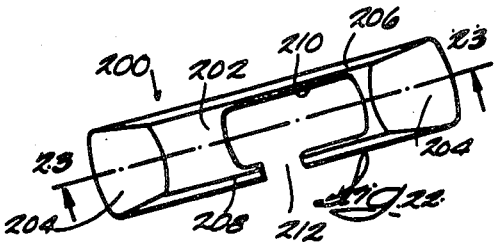
FIG. 22 is a top plan view of a snap-on boot for the club head of the putter shown in FIG. 5.

FIGS. 22 and 23 illustrate a head cover boot 200 made from a relatively rigid resilient material, such as a synthetic plastic. The boot 200 is arranged to snap over the club head in a downward motion. The boot 200 includes a top wall 202 for covering the club head top, inclined end walls 204 for covering the striking faces of the toe and heel, one side wall 206 for covering the putting face and one side wall 208 for covering the back side, of the putter or the other putting face for putters having two putting faces. The top 202 has an opening 210 for receiving the putter hosel or shaft and the side wall 208 had a vertical slot 212 for permitting the boot 200 to be slipped over the shaft above the club head.

Extending inwardly from the bottom edges of the sides 206 and 208 is a plurality of longitudinally spaced, small fingers 214 which are arranged to snap in under the putter sole and retain the boot in place when it is pushed downwardly over the club head.

FIGS. 24 and 25 illustrate a club head having an off center hosel, double putting faces 226 and 228, and a pair of parallel ball troughs 230 and 232 in the top surface. The ball troughs 226 and 228 extend parallel to the longitudinal axis of the club head body and function in the same manner as the ball trough 130 described above. When the club head is tilted over onto straight edge 234, a golf ball placed in the ball trough 230 will roll in the direction of the green slope. Similarly, when the club head is tilted over onto straight edge 236, a golf ball placed in the ball trough 232 will roll in the direction of the green slope.

A centrally located, downwardly projecting rib 240 extending parallel to the longitudinal axis of the club head body and substantially along the entire length of the straight portion of the sole bites into the green and serves as a gripping means as the club head is tilted from an aiming position to an address position. When such a rib is used as the gripping means, the sole usually does not include a recessed portion 97 like in the embodiment shown in FIGS. 5–8 or a recess 90 for recessing weights like in the embodiment shown in FIGS. 1–4.

From the foregoing description, one skilled in the art can easily ascertain the essential characteristics of the invention and, without departing from the spirit and scope thereof, make various changes and modifications to adapt it to various usages.

I claim:

1. A golf putter comprising a club head and a shaft connected to said club head:

said club head having an elongated body including a longitudinal axis extending generally perpendicularly to the putting direction when said club head is in an upright address position for striking a golf ball, a top, a sole, opposed ends and opposed sides, at least one of said sides extending generally parallel to the longitudinal axis of said body and including a putting face;

vertical aiming indicia on said putter normal to said longitudinal axis and visible when said putting face is tilted rearwardly to transversely align said putting face relative to a selected line of putt;

a substantial portion of the juncture between said sole and said side opposite to said putting face forming a sharp corner which extends longitudinally in a substantially straight line generally parallel to the longitudinal axis of said body, said corner resting on a golf green surface when a golfer tilts said shaft and said club head from an address position to an aiming position wherein said putting face is tilted away from the ball to facilitate alignment of said putting face to provide a desired putting line, said corner in the tilted position of the club head being the part of the head and serving as a biting edge means for resisting endwise turning of said club head relative to the desired putting line as the golfer starts to tilt said club head from an aiming position toward an address position; and said sole having longitudinally spaced convex surface portions at least at opposite ends of said biting edge means extending downwardly and forwardly beyond said corner and towards said putting face, said convex surface portions being the lowest portions of said sole for maintaining rolling contact with the green surface to thereby resist endwise turning of said club head relative to the desired putting line after said corner is elevated from the green surface during continued movement of said club head from an aiming position position to an address position.

2. A golf putter according to claim 1 including means on said sole for gripping the green surface to minimize transverse slippage of said club head relative to the desired putting line as the golfer tilts said club head from an aiming position to an address position.

3. A golf putter according to claim 2 wherein said gripping means comprises a projection extending downwardly from each of said convex surface portions.

4. A golf putter according to claim 2 wherein said gripping means comprises each of said convex surface portions including an inner end which terminates in an upward, off set portion and cooperates with said respective convex surface portion to define a sharp corner extending generally perpendicularly to the longitudinal axis of said club head body.

5. A golf putter according to claim 1 wherein said putting face includes a striking area having a generally convex vertical curvature for providing a predetermined range of loft angles depending on the point of contact with a golf ball and a plurality of vertically spaced indicia on said striking area corresponding to a predetermined loft angle when contacted with a golf ball in a direction toward the center of gravity of the golf ball.

6. A golf putter according to claim 5 wherein the range of said loft angles is about 1 to about 10 degrees.

7. A golf putter according to claim 1 wherein said opposed ends of said club head body respectively define a toe and a heel, each having a lofted striking face extending in a plane which is generally perpendicular to the longitudinal axis of said club head body and vertically inclined toward said shaft, said striking faces terminating at a lower edge above the bottommost part of said sole; and said sole includes opposed outer end portions which curve smoothly longitudinally upwardly from a bottommost part of said sole and respectively join said lower edges of said toe and said heel striking faces to serve as surfaces for riding over the ground when said toe or heel is used to strike a golf ball.

8. A golf putter according to claim 7 wherein said ride surface have a generally convex transverse curvature.

9. A golf putter according to claim 7 wherein said toe and heel striking surfaces are inclined at about 20 to about 50 degrees to the vertical.

10. A golf putter according to claim 1 including a ball trough on one side of said club head top and extending longitudinally generally parallel to the longitudinal axis of said club head body, said ball trough having a concave cross section approximating the curvature of a golf ball such that, when said club head is resting on a sloped portion of a green with said putting face tilted toward the green surface, a golf ball placed in said ball trough will roll in the direction of the slope.

11. A golf putter according to claim 1 wherein said shaft extends in a plane which is generally parallel to one of said sides and is offset from said golf head.

12. A golf putter according to claim 1 wherein said shaft includes a straight portion next to said club head, and said vertical aiming indicia is on said shaft straight portion.

13. A golf putter comprising a shaft;

a club head having an elongated body including a longitudinal axis extending generally perpendicularly to the putting direction when said club head is in an upright address position for striking a golf ball, a top, a sole, opposed ends and opposed sides, at least one of said sides extending generally parallel to the longitudinal axis of said body and including a putting face;

a hosel carried by and extending vertically upwardly from said club head;

vertical aiming indicia on said hosel normal to said longitudinal axis and visible when said putting face is tilted rearwardly to transversely align said putting face relative to a selected line of putt;

a substantial portion of the juncture between said sole and said opposite to said putting face forming a sharp corner which extends longitudinally in a substantially straight line generally parallel to the longitudinal axis of said body, said corner resting on a golf green surface when a golfer tilts said shaft and said club head from an address position to an aiming position wherein said putting face is tilted away from the ball to facilitate alignment of said putting face to provide a desired putting line, said corner in the tilted position of the club head being the part of the head and serving as a biting edge means for resisting endwise turning of said club head relative to the desired putting line as the golfer starts to tilt said club head from an aiming position toward an address position; and said sole having longitudinally spaced convex surface portions at least at opposite ends of said biting edge means extending downwardly and forwardly beyond said corner and towards said putting face, said convex surface portions being the lowest portions of said sole for maintaining rolling contact with the green surface to thereby resist endwise turning of said club head relative to the desired putting line after said corner is elevated from the green surface during continued movement of said club head from an aiming position to an address position.

14. A golf putter according to claim 13 including longitudinal alignment indicia on the top of said club head body extending perpendicularly to said aiming indicia.

15. A golf putter according to claim 13 wherein said aiming indicia extends on said putting face and through the center of the "sweet spot" on said putting face.

* * * * *